United States Patent [19]

Hefner, Jr.

[11] 4,278,533

[45] Jul. 14, 1981

[54] CONDITIONER FOR FLOTATION OF OXIDIZED COAL

[75] Inventor: Robert E. Hefner, Jr., Lake Jackson, Tex.

[73] Assignee: The Dow Chemical Company, Midland, Mich.

[21] Appl. No.: 119,251

[22] Filed: Feb. 7, 1980

[51] Int. Cl.[3] ..... B03D 1/02

[52] U.S. Cl. ..... 209/166

[58] Field of Search ..... 209/166, 167; 252/61

[56] References Cited

U.S. PATENT DOCUMENTS

| | | | |
|---|---|---|---|
| 2,173,909 | 9/1939 | Kritchevsky | 209/166 |
| 2,372,624 | 3/1945 | Carpenter | 260/584 C |
| 2,389,763 | 11/1945 | Cahn | 209/16 X |
| 3,076,819 | 2/1963 | Heise | 260/584 C X |
| 3,251,852 | 5/1966 | DeCrote | 260/584 C X |
| 3,363,758 | 1/1968 | Cronberg | 209/166 |
| 3,595,390 | 7/1971 | Booth | 209/166 |
| 4,168,227 | 9/1979 | Polgaire | 209/166 |

FOREIGN PATENT DOCUMENTS

| | | | |
|---|---|---|---|
| 523895 | 4/1956 | Canada | 252/61 |
| 782107 | 9/1957 | United Kingdom | 252/61 |

*Primary Examiner*—Robert Halper

*Attorney, Agent, or Firm*—Michael L. Glenn

[57] ABSTRACT

Certain ether amines and their derivatives are useful to improve the recovery of clean coal in a froth flotation process. The presence of these ether amines and derivatives in the flotation medium is particularly effective to enhance the recovery of oxidized bituminous coal.

10 Claims, No Drawings

CONDITIONER FOR FLOTATION OF OXIDIZED COAL

BACKGROUND OF THE INVENTION

This invention relates to the froth flotation of coal-containing ashes, coal sludge or coal-containing residues to recover coal containing a lower percentage of impurities. In particular, this invention relates to the use of an ether amine, a hydroxyalkylated ether amine or a condensation product of an ether amine or hydroxyalkylated ether amine and a fatty acid as a conditioner for the flotation of finely-divided coal.

The natural process of "coalification" inherently deposits some non-combustible mineral matter in association with the combustible carbonaceous solids. Large fragments of non-combustible material can be removed by screening or other gravity concentration techniques, but other cleaning methods more efficiently remove fine material intimately associated with the carbonaceous solids. Froth flotation of coal is used in the art to beneficiate finely-divided raw coal. Bituminous coals generally possess a natural hydrophobicity, which results in the coal being floatable in the presence of a frother, such as methyl isobutyl carbinol, and a relatively mild collector, such as kerosene. On the other hand, anthracite coals, as well as coals of all ranks in which the surface has been at least partially oxidized, float poorly in such a medium, resulting in the loss of significant amounts of combustible material in the tail from the flotation.

The loading of the kerosene or fuel oil collector is generally 0.05 to 1 kilogram per metric ton of coal feed for bituminous coals of intermediate or low rank, with the loading being relatively greater for the flotation of lignite and anthracite coals. However, good recovery of oxidized coals or lignite coals can only be effected at such high loadings of the oil-type collector that significant amounts of inert material are floated along with the combustible materials. Sun suggests in *Trans AIME,* 199:396–401 (1954), that fatty amines can be utilized as co-collectors in the flotation of coals to effect enhanced recovery. However, even these amine collectors float substantial amounts of ash along with the coal and effect only partial recovery of combustible material.

SUMMARY OF THE INVENTION

According to this invention, coal is beneficiated in a froth flotation process comprising the steps of (a) classifying the coal to separate particles of flotation size, and (b) floating the sized coal in a frothing aqueous medium comprising a fuel oil collector and an effective amount of a compound or a mixture of compounds selected from the group consisting of (1) an ether amine or hydroxyalkylated ether amine represented by formula I,

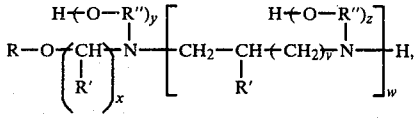

I (2) a condensation product of a compound of formula I with an organic carboxylic acid or its ester in a molar ratio of at least about 1 mole of organic carboxylic acid or ester per mole of the ether amine or derivative, and (3) an acid derivative of the compound of formula I or its condensation product.

In the above formulas, R′ at each occurrence is independently hydrogen or methyl; each R″ is independently

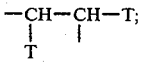

wherein T at each occurrence is independently hydrogen, methyl or ethyl, with the proviso that R″ at each occurrence contains no more than 4 carbons atoms; v, w, y and z are each independently 0 or 1; x is 2 or 3 and R is an aryl, alkyl, alkenyl, alkynyl, aralkyl or alkaryl having from 1 to about 22 carbon atoms, with the proviso that if the conditioner employed in flotation is not a condensation product of the compound of formula I or an acid derivative thereof, then in formula I, y and z are both O and R is an alkyl-substituted phenyl, alkenyl or alkyl and contains at least about 10 carbon atoms.

The term "conditioner" indicates that the condensation product is primarily effective to selectively enhance the hydrophobicity of the coal surface. The term conditioner refers to not only the condensation products, but also the ether amine and its hydroxyalkylated derivatives as well as salts thereof. The use of the descriptive term "conditioner" is not intended to exclude the possibility that this condensation product acts as a co-collector with the fuel oil or kerosene collector.

Detailed Description of the Invention

The alkyl ether amines corresponding to formula I, wherein x is 3, y and z are O and R is alkyl or aralkyl, are well-known compounds. The ether monoamines (i.e., where w is O) can be prepared by cyanoethylation of a primary aliphatic alcohol to prepare the corresponding ether nitrile, which is then hydrogenated to prepare the corresponding ether amine. The preparation of these ether amines is taught in U.S. Pat. No. 3,076,819 and 3,363,758. Certain of the alkyl ether diamines (i.e., where w is 1 and v is 1 in the compound of formula I) can be prepared by reacting the alkyl ether monoamine with acrylonitrile or methacrylonitrile and then hydrogenating the resulting ether amine nitrile. The other alkyl ether diamines (i.e., where w is 1 and v is 0) are conveniently prepared by reacting an ether monoamine with chloroacetonitrile and then hydrogenating the resulting ether amine nitrile. A similar reaction is taught in German Offen. No. 2,515,383, the relevant portions of which are incorporated by reference.

The ether monoamines represented by formula I (wherein w and y are both 0), are conveniently prepared in a two-step process. First, a 2-alkyl-2-oxazoline or an oxazine represented by the formula

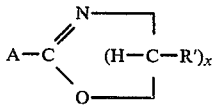

II where R′ and x have the aforementioned identities, and A is a phenyl or $C_1$–$C_{20}$ aliphatic radical, is reacted at about 150° C. to about 250° C. in a liquid phase with an alkylated phenol represented by the formula

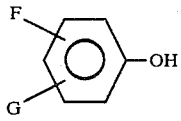

III wherein F and G are each independently hydrogen or a $C_1$–$C_{20}$ aliphatic radical, to prepare the corresponding amide. This amide represented by the formula

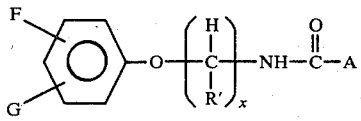

IV is then hydrolyzed to produce an ether amine represented by formula I. Alternatively, the monoalkanolamine and carboxylic acid precursors of the 2-oxazoline or the oxazine can be employed in place of the heterocyclic reactant at reaction conditions conductive to the formation of the heterocyclic product. The corresponding ether diamines can be prepared by reacting the ether monoamine with acrylonitrile, methacrylonitrile, or chloroacetonitrile followed by hydrogenation of the resulting ether amine nitrile.

In a preferred embodiment of the instant invention the amide represented by formula IV, wherein A is a $C_1$–$C_{20}$ aliphatic radical, can be used directly as a conditioner for the flotation of coal. For the purposes of this application these products are referred to as condensation products, whether they are prepared by the reaction of an oxazoline or oxazine and a phenol or by the reaction of an ether amine and a carboxylic acid.

The hydroxyalkylated derivatives of the above-described ether amines (i.e., where y or z is 1) are readily prepared by reacting one or two equivalents of ethylene oxide, propylene oxide, 2,3-butylene oxide, 1,2-butylene oxide or a mixture thereof with one of the aforementioned ether amine compounds in a manner known to the art.

The compound of formula I can be condensed with an organic carboxylic acid or its ester by bringing these reactants together and heating until the desired degree of condensation has taken place, as indicated by the water distilled overhead or infrared spectrophotometric analysis of the condensation product. Generally, a reaction temperature of from about 120° C. is operable. The reaction is termed a condensation herein to distinguish it from the formation of the ammonium salt of the acid at lower temperatures. Dependent on the reactant, the condensation product may be an ester, an amide or both. Although it is desirable that the condensation reaction is substantially complete to make most efficient use of the reactants, the condensation product is operable, but less effective, as a conditioner for coal in the presence of a substantial amount of unreacted carboxylic acid and the uncondensed alkanolammonium salt of the acid.

The organic carboxylic acid condensed with the compounds of formula I can operably be an acid represented by the formula

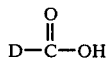

V wherein D is an aliphatic radical having 1 to 22 carbon atoms. Representative acids include acetic, propionic, butyric, linoleic, oleic, lauric acid and the like, the so-called "fatty acids" having from 4 to 22 carbon atoms. The fatty acid can suitably bear hydroxyl substituents on its alkyl portion, but such substitution is not generally desirable. Fatty acids such as oleic, lauric, linoleic, palmitic, stearic, myristic, mixtures thereof and other like fatty acids are operable. The esters corresponding to these fatty acids, such as glycerides, are also operable, but less preferred. For reasons of economy, it is preferred to use crude mixtures of fatty acids, rosin acids, lignin and unsaponifiable material, such as tall oil, coconut oil, palm oil, palm kernel oil, cottonseed oil, linseed oil, olive oil, peanut oil, fish oil and the like. Tall oil is an especially preferred mixture of fatty acids and rosin acids.

The efficacy of the instant organic carboxylic acid condensation product is greatest when the reactants are condensed in a specific range of mole ratios. When the condensation product is derived from the ether amine of formula I, preferably at least about one acid equivalent is condensed with each equivalent of amine. When the condensation product is prepared from a hydroxyalkylated compound of formula I, advantageously at least about one equivalent of fatty acid is condensed with each equivalent of a hydroxy or secondary amine moiety. To avoid waste of fatty acid, the number of moles of fatty acid and/or ester reacted with the compound of formula I should not exceed the number of moles of the compound of formula I multiplied by the average number of reactive sites on a molecule of the compound. The term "reactive sites" refers to the exchangeable hydrogen substituents on the amine group(s) and the reactive hydroxyl substituents on the hydroxyalkyl group(s), which will react with the fatty acid or fatty acid ester to produce amides and esters respectively. In the foregoing mole ratios, the moles of fatty acid in crude mixtures derived from natural sources do not include the moles of such minor generally inert components as unsaponifiable matter.

The above-described ether amines and derivatives neutralized or partially neutralized with inorganic or organic acids are also operable in the instant flotation process. These derivatives are generally more readily dispersed in the aqueous flotation medium than are the parent compounds but may be less active. These acid derivatives may be salts, partial salts or acid complexes. Common inorganic acids which can be used include phosphoric, nitric, boric, hydrochloric, hydrobromic and sulfuric acids. Organic acids which can be used include aliphatic mono-, di- or tricarboxylic acids; lower alkyl carboxylic acids; mono- or dihydroxy lower alkyl carboxylic acids and amino-substituted compounds thereof; and unsaturated aliphatic acids. Examples of these organic acids include formic, acetic, hydroxyacetic, propionic, butyric, isovaleric, lactic, gluconic, aminoacetic, malonic, succinic, adipic, malic, tartaric, glutaric, maleic, fumaric, citric, isocitric, aconitic, oxalic, salicylic, benzoic, naphthenic acids, and the like. Fatty acids can also be employed for this purpose, but are not as desirable as the lower organic acids. The $C_1$ to $C_4$ organic acids are preferred. Acetic acid is particularly preferred to prepare acid derivatives.

Certain of the aforementioned compounds represented by formula I demonstrate greater activity than others. For this reason, it is preferred that R is a $C_5$–$C_{18}$ alkyl or an alkyl-substituted phenyl containing from 14 to 18 carbon atoms. It is also preferred that R' is hydrogen and that y and z are each 1. Preferably, w is 0. The organic carboxylic acid condensates are generally more effective conditioners than the parent compounds and are therefore preferred.

The loading of the ether amine of formula I or its derivatives in the flotation medium which affects the greatest recovery of combustible carbonaceous matter with a tolerable amount of inert matter is affected by the size, rank, degree of oxidation and inert matter content of the coal feed, as well as the loading of frother and other adjuvants. The term effective amount is used herein to denote the amount of said compounds required to increase the recovery of coal by froth flotation in the presence of fuel oil and a frother. Generally, where this conditioner is employed with only fuel oil and a frother, the conditioner is advantageously employed in a ratio of from about 0.001 to about 1.0, preferably about 0.005 to about 0.5 kilograms, of conditioner per metric ton of coal flotation feed.

The instant conditioner can be utilized in conjunction with co-collectors or other adjuvants, such as activators, conditioning reagents, dispersing reagents, frothing reagents and depressing reagents. Fuel oil is employed in the flotation medium as a collector and/or dispersing reagent. Representative fuel oils include diesel oil, kerosene, Bunker C fuel oil, mixtures thereof and the like. The fuel oil can generally be advantageously employed in a ratio of from about 0.02 to about 2.5 kilograms fuel oil per metric ton of coal flotation feed. The optimal loading of fuel oil in the flotation medium is influenced by numerous factors, such as the size, degree of oxidation and rank of the coal to be floated and the loading of condensate and frother. Therefore, the loading of the fuel oil should be optimized empirically to effect the greatest selectivity and recovery during flotation. It is generally desirable to introduce the ether amine or derivative to the flotation medium as an emulsion in fuel oil.

A frothing agent should be present in the flotation medium to promote formation of a froth. Conventional frothers, such as pine oil, cresol, isomers of amyl alcohol and other branched $C_4$–$C_8$ alkanols are suitable for this purpose. However, methyl isobutyl carbinol and polypropylene glycol alkyl or phenyl ethers are preferred as frothers, with polypropylene glycol methyl ethers having a weight average molecular weight of from 200 to 600 being more preferred. The optimal loading of frother in the flotation medium is influenced by a number of factors, most important of which is the particle size, rank and degree of oxidation of the coal. Generally, a ratio of from 0.05 to about 0.5 kilogram frother per metric ton of coal feed is advantageous.

The coal to be floated by the instant process can suitably be anthracite, bituminous, subbituminous and the like. This process is preferably employed to float coal which cannot be floated with conventional frothers alone and is particularly effective in the flotation of butiminous coal of intermediate or low rank, where the surface of the coal is oxidized to an extent which significantly impedes the flotation of the coal by conventional methods.

The size of the coal flotation feed is important as generally particles larger than about 28 mesh (U.S. Sieve Size) are difficult to float. In typical operations, coal particles larger than 28 mesh, advantageously larger than 100 mesh, are separated from both the inert material mined therewith and more finely divided coal by gravimetric separation techniques. However, if a substantial fraction of the coal in the flotation feed is contained in particles larger than 28 mesh, it is desirable that the feed is comminuted prior to flotation.

The sized coal flotation feed in preparation for flotation is first optionally washed and then mixed with sufficient water to prepare an aqueous slurry having a concentration of solids which promotes rapid flotation. Generally, a solids concentration of from about 2 to about 20 weight percent solids, more preferably about 5 to about 15 weight percent, is preferred. The aqueous coal slurry is desirably conditioned with the conditioner, a frother, fuel oil and any other adjuvants by mixing or agitating the slurry prior to flotation in a manner known to the art. Generally for coal that is difficult to float, it is advantageous to contact the coal slurry with the conditioner and fuel oil by mixing for a period of time prior to flotation, so as to effect intimate contact of the conditioner and fuel oil with substantially all of the coal. Where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. The frother, however, should be introduced to the slurry shortly before or during flotation to provide maximum frothing.

The coal is operably floated at the natural pH of the coal in the aqueous slurry, which can vary from about 3.0 to about 9.5 depending upon the composition of the feed. However, a pH adjusting composition is optionally used as necessary to adjust and maintain the pH of the aqueous coal slurry prior to and during flotation to a value from about 4 to about 9, preferably about 6 to about 8, which promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid, such as acetic acid and the like, or a mineral acid, such as sulfuric acid, hydrochloric acid and the like, is operable to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

The following examples are illustrative embodiments of this invention. Unless otherwise indicated, all parts and percentages are by weight.

EXAMPLE 1

In a series of substantially identical flotation runs that differ principally in the identity of the frother and presence or absence of a conditioner, a 200 gram charge of comminuted coal is diluted with deionized water to a slurry of 6.67 percent solids. The coal is a low grade, bituminous coal having a highly oxidized surface as indicated by the high oxygen content (14.3 percent) of the coal. The fraction of the coal feed consisting of particles larger than 25 mesh is separated before dilution, comminuted and then recombined with the remainder of the coal. The comminuted coal feed is more than 90 percent particles smaller than 80 mesh. The coal as charged to the slurry contains about 14.7 percent ash.

This aqueous coal slurry is introduced into a flotation machine (specifically, a Galigher Agitair Flotation Machine) having a three-liter cell. The pH of the slurry is determined to be about 4. Sufficient sodium hydroxide is added to the slurry to adjust the pH to 7. The coal slurry is agitated for about seven minutes to thoroughly wet the coal, at which time a refined kerosene (sold under the tradename SOLTROL 100 by Phillips Petroleum Co.) is added to the slurry to effect a loading of about 2.5 kilograms of kerosene per ton of coal feed. One-half milliliter (ml) of a kerosene solution containing 5 percent of a compound corresponding to formula I, wherein w and y are each O, R′ is hydrogen and R is selected from a univalent aliphatic radical having 7 to 9 carbon atoms (in which x is 3 in formula I) or a nonyl- or dodecyl-substituted phenyl (in which x is 2), is added in each of 4 runs. The $C_7$ and $C_9$ aliphatic ether amines are sold commercially by Ashland Chemical Company under the tradenames AROSURF MG-70 and AROSURF MG-98. The alkyl-substituted phenyl ether amines are prepared by the reaction of equimolar amounts of an alkylated phenol, propionic acid and monoethanolamine in a liquid phase reaction medium at 150°–250° C. followed by acid-catalyzed hydrolysis of the ether amide product to the desired ether amine. One control flotation run is also made, in which 5 ml of kerosene is introduced in place of the conditioner solution.

Next 0.04 ml of a polypropylene glycol methyl ether frothing agent having an average molecular weight of about 400 is added to the medium as a frothing agent. The aqueous coal slurry is conditioned with the aforementioned reagents by agitation for one minute, after which aeration of the medium is initiated and continued for four minutes. A frothy concentrate is collected during aeration.

The collected concentrate is first dried in an oven and then weighed. The percent recovery of coal by flotation is determined from the weight of coal in the concentrate divided by the weight of coal (i.e., total weight less weight of ash) in the 200 gram charge. A one-gram sample of the concentrate is completely burned and the ash content of the concentrate is determined from the weight of the material remaining after combustion. Table I tabulates the identity of the conditioner for each run as well as the percent recovery of coal and the ash content of the concentrate.

TABLE I

| Run | Ether Amine Conditioner | Coal Recovery (%) | Ash Content (%) |
|---|---|---|---|
| A* | $C_7$ Aliphatic | 38.9 | 11.3 |
| B* | $C_9$ Aliphatic | 34.5 | 11.5 |
| C | $C_9$ Alkyl–⟨phenyl) | 42.0 | 10.1 |
| D | $C_{12}$ Alkyl–⟨phenyl) | 50.1 | 10.6 |
| E* | None | 34.0 | 9.1 |

*Not an embodiment of this invention.

EXAMPLE 2

A single flotation run is performed in the same manner as Example 1, with the exception of the conditioner employed. One-half ml of a kerosene solution containing 5 percent of a compound represented by formula I, wherein x is 3, v and w are each 1, y and z are each 0, R′ is hydrogen at each occurrence and R is a univalent aliphatic radical having 15 carbon atoms, is added to the flotation medium. This aliphatic ether amine is sold commercially by Ashland Chemical under the tradename AROSURF MG-584. The coal recovery for this run is 51.2 percent and the ash content of the concentrate is 9.9 percent.

EXAMPLE 3

A single flotation run is performed in the same manner as Example 1, with the exception of the conditioner employed. One-half ml of a kerosene solution containing 5 percent of a compound represented by formula IV, wherein x is 2, R′ is hydrogen, A is propionyl, F is hydrogen and G is dodecyl, is added to the flotation medium. The coal recovery for this run is 50.1 percent and the ash content of the concentrate is 10.6 percent.

EXAMPLE 4

A pair of flotation runs are performed in the same manner as Example 1, except that the conditioner employed is a condensate of the nonyl and nonylphenyl ether amines employed in Runs B and C of Example 1 with an equimolar amount of tall oil fatty acid. These condensates are prepared by reacting the appropriate ether amine with tall oil fatty acid at a temperature from about 130° C. to about 225° C. until the reaction is substantially complete. The tall oil fatty acid reactant is one sold by Emery Industries, Inc. under the tradename EMTALL 729. This tall oil fatty acid according to analysis by conventional methods contains 39 percent rosin acids, 29.3 percent oleic acid, 23 percent linoleic acid, 3.7 percent conjugated linoleic acid, 1.8 percent stearic acid and about 5 percent other acids and components. These fatty acid condensates are introduced into the flotation medium in kerosene solutions at the same loading as in Example 1. The identifying parameters and flotation results for each run are tabulated in Table II.

TABLE II

| Run | R | Coal Recovery (%) | Ash Content (%) |
|---|---|---|---|
| A | $C_9$ Aliphatic | 57.2 | 9.9 |
| B | $C_9$ Alkyl–⟨phenyl) | 62.0 | 9.8 |

EXAMPLE 5

A series of flotation runs are performed in the same manner as Example 1, with the exception of the conditioner employed. To prepare the instant conditioners, the ether amine compounds introduced in Runs A–C of Example 1 and in Example 2 are each reacted in the conventional manner with one equivalent of propylene oxide for each amine equivalent borne by the ether amine. These condensates are then reacted with two equivalents of tall oil fatty acid for the hydroxyalkylated ether amines wherein R in the formula of these compounds is heptyl, nonyl or a nonyl-substituted phenyl and with three equivalents of tall oil fatty acid wherein R is a $C_{15}$ aliphatic group. The condensation reaction is similar to and the tall oil fatty acid is identical to that employed in Example 4. These fatty acid condensates are introduced into the flotation medium in kerosene solutions at the same loadings as in Example 1. The identifying parameters and floation results for each run are tabulated in Table III.

TABLE III

| Run | R | Coal Recovery (%) | Ash Content (%) |
|---|---|---|---|
| A | $C_7$ Aliphatic | 62.1 | 10.3 |
| B | $C_9$ Aliphatic | 60.3 | 10.1 |
| C | $C_{15}$ Aliphatic | 63.2 | 10.7 |
| D | $C_9$ Alkyl–(phenyl) | 61.6 | 10.0 |

EXAMPLE 6

A pair of flotation runs are performed in the same manner as Example 1, except that the conditioner employed is an amide represented by formula IV, wherein F is nonyl or dodecyl, G is hydrogen and A is ethyl. These amides are prepared by the reaction of equimolar amounts of the appropriate alkylated phenol with propionic acid and monoethanolamine at about 150°–250° C. The amide is then recovered by fractional distillation. The identifying parameters and flotation results for each run are tabulated in Table IV.

TABLE IV

| Run | Ether Amide Conditioner | Coal Recovery (%) | Ash Content (%) |
|---|---|---|---|
| A | $C_9$ Alkyl–(phenyl) | 57.1 | 9.6 |
| B | $C_{12}$ Alkyl–(phenyl) | 59.0 | 9.4 |

What is claimed is:

1. A froth flotation process for beneficiaing coal of flotation size which comprises floating the sized coal in a frothing aqueous medium comprising a fuel oil collector and an effective amount of a conditioner selected from the group consisting of (1) an ether amine or hydroxyalkylated ether amine represented by the formula I:

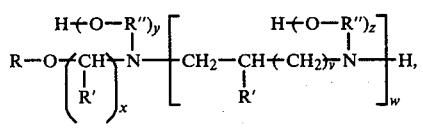

I wherein each R′ is independently hydrogen or methyl, each R″ is independently

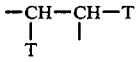

wherein T at each occurrence is independently hydrogen, methyl or ethyl, with the proviso that R″ at each occurrence contains no more than 4 carbon atoms; v, w, y, and z are each independently 0 or 1; x is 2 or 3 and R is an aryl, alkaryl, alkyl, aralkyl, alkenyl or alkynyl having from 1 to about 22 carbon atoms; (2) a condensation product of a compound of formula I with an organic carboxylic acid or its ester in a molar ratio of at least about 1 mole acid or ester per mole of the ether amine or derivative; and (3) an acid derivative of the compound of formula I or its condensation product;

with the proviso that if the conditioner employed in flotation is not a condensation product of the compound of formula I or an acid derivative thereof, then in formula I, y and z are both O and R is an alkyl-substituted phenyl or an alkenyl or alkyl having at least 10 carbon atoms.

2. The process as described in claim 1 wherein the coal is a bituminous coal having an oxidized surface.

3. The process as described in claim 1 wherein R is a $C_5$–$C_{18}$ alkyl or an alkyl-substituted phenyl having from 14 to 18 carbon atoms.

4. The process as described in claim 3 wherein R′ is hydrogen.

5. The process as described in claim 4 wherein the conditioner is a condensation product of a compound of formula I with an organic carboxylic acid or its ester.

6. The process as described in claim 5 wherein y and z are each 1.

7. The process as described in claim 6 wherein w is 0.

8. The process as described in claim 1 wherein the frothing aqueous medium further comprises an effective amount of a conventional frothing agent.

9. The process as described in claim 8 wherein the frothing agent is methyl isobutyl carbinol.

10. The process as described in claim 8 wherein the frothing agent is a monomethylether of a polypropylene glycol of about 200 to about 600 weight average molecular weight.

* * * * *

UNITED STATES PATENT AND TRADEMARK OFFICE

CERTIFICATE OF CORRECTION

PATENT NO. : 4,278,533

DATED : July 14, 1981

INVENTOR(S) : Robert E. Hefner, Jr.

It is certified that error appears in the above—identified patent and that said Letters Patent is hereby corrected as shown below:

Column 2, line 13, "carbons" should be singular;

Column 2, line 65, delete "where" and insert -- wherein --;

Column 3, line 22, "conductive" should be -- conducive --;

Column 3, line 49, after "120°C." insert -- to about 250° --;

Column 5, line 59, "bituminous" is misspelled;

Column 7, line 16, "to" should be -- or --;

Column 8, line 67, "flotation" is misspelled;

Column 9, line 29, "beneficiating" is misspelled.

Signed and Sealed this

*Second* Day of *February 1982*

[SEAL]

*Attest:*

GERALD J. MOSSINGHOFF

*Attesting Officer*

*Commissioner of Patents and Trademarks*